US007862031B2

(12) United States Patent
Kaseda

(10) Patent No.: US 7,862,031 B2
(45) Date of Patent: Jan. 4, 2011

(54) FEEDER AND IMAGE FORMING APPARATUS INCLUDING THE SAME

(75) Inventor: Shinya Kaseda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 3 days.

(21) Appl. No.: 12/357,591

(22) Filed: Jan. 22, 2009

(65) Prior Publication Data

US 2009/0189329 A1 Jul. 30, 2009

(30) Foreign Application Priority Data

Jan. 24, 2008 (JP) ..... 2008-013883

(51) Int. Cl.
*B65H 3/52* (2006.01)
*B65H 1/08* (2006.01)

(52) U.S. Cl. ..... 271/121; 271/126; 271/160; 271/167

(58) Field of Classification Search ..... 271/121, 271/126, 160, 167
See application file for complete search history.

(56) References Cited

U.S. PATENT DOCUMENTS 4,280,692 A * 7/1981 Hutchinson et al. ..... 271/160
2007/0001376 A1* 1/2007 Lim et al. ..... 271/121

FOREIGN PATENT DOCUMENTS

| | | |
|---|---|---|
| JP | 58-79743 | 5/1983 |
| JP | 59-91237 | 6/1984 |
| JP | 62-53251 | 4/1987 |
| JP | 06-199439 | 7/1994 |

* cited by examiner

*Primary Examiner*—David H Bollinger
(74) *Attorney, Agent, or Firm*—Marvin A. Motsenbocker; Mots Law, PLLC

(57) ABSTRACT

A media feeder is provided, which includes: a raisable and lowerable hopper on which multiple media are stacked; an elevator moving the hopper to a raised or lowered position; a pick-up roller picking up an upper media stacked on the hopper by rotating while contacting the uppermost media when the hopper is at the raised position; a friction member disposed on the upper surface of the hopper, at a position facing the pick-up roller; and a projecting member disposed below the hopper. The hopper includes a window hole formed in the vicinity of the friction member. When the hopper is at the lowered position, the projecting member projects from the upper surface of the hoper through the window hole. Thus, when media are placed in the feeder, even the lowermost medium does not come into contact with the friction member, thereby facilitating the placement and positional adjustment of the media.

14 Claims, 11 Drawing Sheets

FEEDER AND IMAGE FORMING APPARATUS INCLUDING THE SAME

CROSS REFERENCE TO RELATED APPLICATIONS

This application claims priority based on 35 USC 119 from prior Japanese Patent Application No. P2008-013883 filed on Jan. 24, 2008, entitled "Feeder and Image Forming Apparatus Including the Same", the entire contents of which are incorporated herein by reference.

BACKGROUND OF THE INVENTION

1. Field of the Invention

The present invention relates to a feeder and an image forming apparatus including the feeder.

2. Description of Related Art

A feeder used for an image forming apparatus such as an inkjet printer, an electrophotographic printer, a facsimile and a copier includes a paper feed tray called a paper cassette capable of accommodating multiple printing paper sheets, i.e., printing media. The paper feed tray includes a hopper formed of a plate-like body to support stacked media from the bottom. Moreover, a pick-up roller is disposed above the paper feed tray. The pick-up roller rotates while in contact with the uppermost of stacked media placed on the hopper, thereby picking up the uppermost medium from the paper feed tray.

At this point, the hopper pushes up the medium from the bottom, and presses the medium against the pick-up roller. When the pick-up roller rotates under this condition, two or more stacked media may be conveyed downstream at a time by friction between the media. To address this problem, Japanese Patent Application Publication No. 2004-269116, for example, proposes a feeder with a friction member disposed on the upper surface of a hopper at a position facing a pick-up roller (mainly a downstream end portion of the hopper in the medium-feeding direction). This configuration makes more friction between the uppermost medium and the hopper than between the media therein.

However, the aforementioned conventional feeder has the following problem. Specifically, when media are placed in a paper feed tray, the lowermost medium comes into contact with the surface of the friction member. This disturbs the placing of media, so that the lowermost of stacked media thus placed may be misplaced from an intended position. Since the lowermost medium contacts the friction member, it is difficult to adjust the position of the medium via a medium guide provided to the feeder once the media have been placed in the paper feed tray.

SUMMARY OF THE INVENTION

An aspect of the invention provides a feeder that comprises: a raisable and lowerable hopper on which a plurality of media are stacked; an elevator configured to move the hopper to any one of a raised position and a lowered position; a pick-up roller configured to pick up an uppermost media stacked on the hopper by rotating while contacting the uppermost medium when the hopper is at the raised position; a friction member disposed on an upper surface of the hopper at a position facing the pick-up roller; and a projecting member disposed below the hopper, wherein the hopper includes a window hole formed in the vicinity of the friction member, and when the hopper is at the lowered position, the projecting member projects from the upper surface of the hoper through the window hole.

Another aspect of the invention provides a feeder that comprises: a raisable and lowerable hopper on which a plurality of media are stacked; an elevator configured to move the hopper to any one of a raised position and a lowered position; a pick-up roller configured to pick up an uppermost one of the media stacked on the hopper by rotating while contacting the uppermost medium when the hopper is at the raised position; and a friction member disposed at a position corresponding to a portion, facing the pick-up roller, of an upper surface of the hopper, wherein the friction member is raisably and lowerably attached to the hopper, when the hopper is at the raised position, the friction member is positioned above the upper surface of the hopper, and when the hopper is at the lowered position, the friction member is positioned below the upper surface of the hopper.

Still another aspect of the invention provides an image forming apparatus that comprises: a feeder including: a raisable and lowerable hopper on which a plurality of media are stacked; an elevator configured to move the hopper to any one of a raised position and a lowered position; a pick-up roller configured to pick up an uppermost media stacked on the hopper by rotating while contacting the uppermost medium when the hopper is at the raised position; a friction member disposed on an upper surface of the hopper, at a position facing the pick-up roller; a projecting member disposed below the hopper; a conveying roller configured to convey the medium picked up by the pick-up roller; an image former configured to transfer a toner image to the medium conveyed by the conveying roller; an image fixer configured to fix the toner image to the medium; and a discharge roller configured to discharge the medium having the fixed toner image to the outside, wherein the hopper includes a window hole formed in the vicinity of the friction member, and when the hopper is at the lowered position, the projecting member projects from the upper surface of the hopper through the window hole.

In the image forming apparatus, the friction member is disposed at a position facing the pick-up roller above the raisable and lowerable hopper, and the projecting member that can project from the surface of the hopper is disposed around the friction member. When the hopper is at a lowered position, the projecting members project from the hopper. Thereby, when media are placed in the feeder, even the lowermost medium does not come into contact with the friction member. Moreover, media setting and positional adjustment of the media are facilitated.

DETAILED DESCRIPTION OF EMBODIMENTS

A feeder and image forming apparatus including the same according to embodiments are described in more detail. However, the present invention is not limited to the following embodiments and can be appropriately changed without departing from the spirit and scope of the invention.

Figure 2:
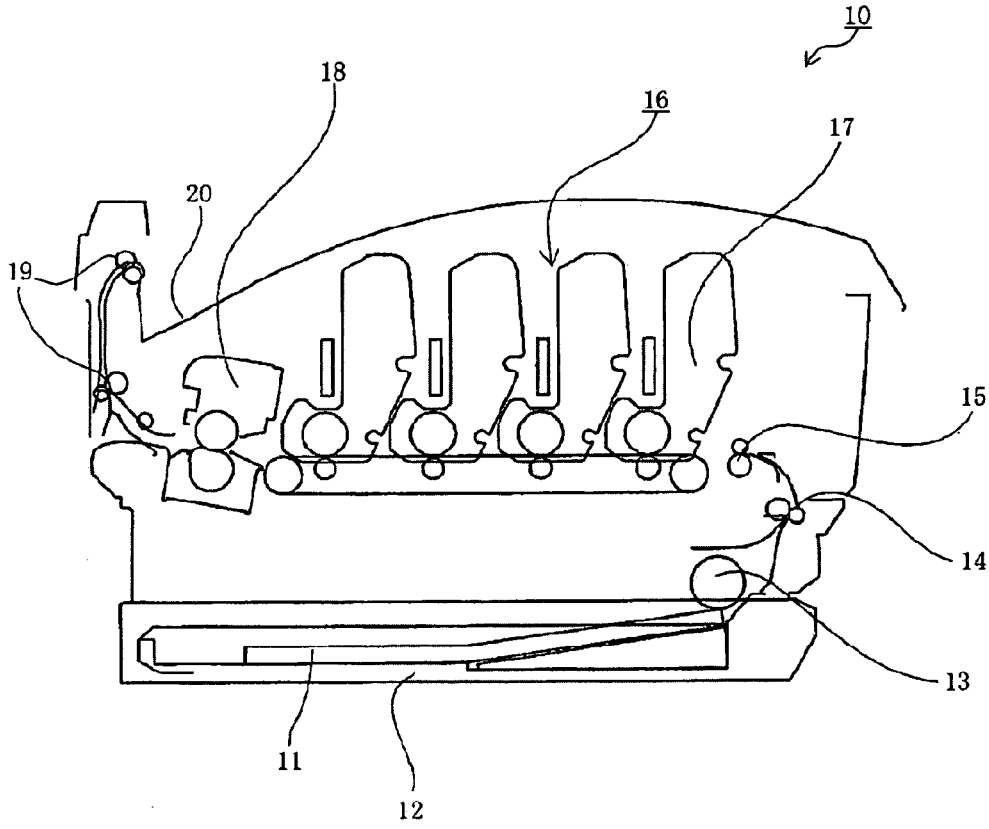
FIG. 2 is a cross-sectional view of an image forming apparatus in the first embodiment.

FIG. 2 is a cross-sectional view of an image forming apparatus of a first embodiment. In FIG. 2, reference numeral 10 denotes an image forming apparatus of this embodiment, which is, for example, a printer, a facsimile, a copier, a multifunctional machine having these various functions, or the like. Image forming apparatus 10 may be of any type, but the description is given wherein image forming apparatus 10 is a printer. Moreover, image forming apparatus 10 may be an apparatus that employs any type of printing method such as an inkjet method, an electrophotographic method and a thermal transfer method. Here, image forming apparatus 10 is an electrophotographic printer employing an electrophotographic method. Furthermore, image forming apparatus 10 may be a monochrome printer that forms a monochrome image, but herein the description is given of a case where image forming apparatus 10 is a color printer that forms a color image.

In this case, as shown in the drawing, image forming apparatus 10 includes an image former 16 in which four process units 17 are disposed in tandem with one another along a conveying path of medium 11 such as a printing paper sheet. Process units 17 are configured to form images of yellow, magenta, cyan and black colors, respectively. Image forming apparatus 10 further includes a feeder whose paper feed tray 12 is detachably mounted on the bottom portion of image forming apparatus 10. Media 11 stacked on each other in paper feed tray 12 are fed one by one from paper feed tray 12 and conveyed along the conveying path by a conveying belt or the like.

Image forming apparatus 10 further includes paper-feeding roller 13 as a pick-up roller made of rubber. Paper-feeding roller 13 is disposed at a position above paper feed tray 12 so as to face an end portion, of paper feed tray 12, on a paper-feeding direction side. Paper-feeding roller 13 is configured to rotate while contacting uppermost medium 11 among multiple media 11 accommodated in paper feed tray 12, and to feed media 11 one by one. Furthermore, the medium conveying unit is provided with conveying rollers 14 and 15 that are driven by an unillustrated conveying motor. Conveying rollers 14 and 15 are configured to rotate to convey medium 11 fed from paper feed tray 12 to image former 16 on the downstream side.

Each process unit 17 provided in image former 16 includes: a photosensitive drum as an image carrier; a charging device for supplying electric charge to the surface of the photosensitive drum so as to electrically charge the surface; an exposure device for writing an electrostatic latent image on the already-charged surface of the photosensitive drum; a developing device for developing the electrostatic latent image by a toner of each color to form a toner image; and a cleaning device for removing the toner remaining on the surface of the photosensitive drum after the toner image is transferred to medium 11. Moreover, a transfer roller is disposed below each process unit 17 so as to oppose the photosensitive drum with the conveying path for media 11 in between. The toner image on the surface of the photosensitive drum is transferred to medium 11 by the transfer roller.

Furthermore, image fixer 18 is disposed downstream of image former 16. Image fixer 18 is configured to fix the transferred toner images on medium 11. Image fixer 18 includes a pair of a heat roller and a pressure roller. The toner images are fixed on medium 11 by heating and pressuring the toner image.

Subsequently, medium 11 having the toner images thus fixed by image fixer 18 is conveyed via a medium discharger. Discharge rollers 19 are disposed in the medium discharger, and are configured to convey medium 11. Medium 11 having the fixed toner images is discharged, by discharge rollers 19, to discharged-medium stacker 20 disposed downstream of the medium discharger.

Note that image forming apparatus 10 includes: a driver having a motor, gear, belt, and the like (unillustrated) for driving movable members such as various rollers disposed in image forming apparatus 10; a control panel, communication interface, and the like (unillustrated); and also a controller for controlling an operation of image forming apparatus 10.

Next, specific description is given of a configuration of paper feed tray 12, which is mounted on image forming apparatus 10 having the above-described configuration.

Figure 1:
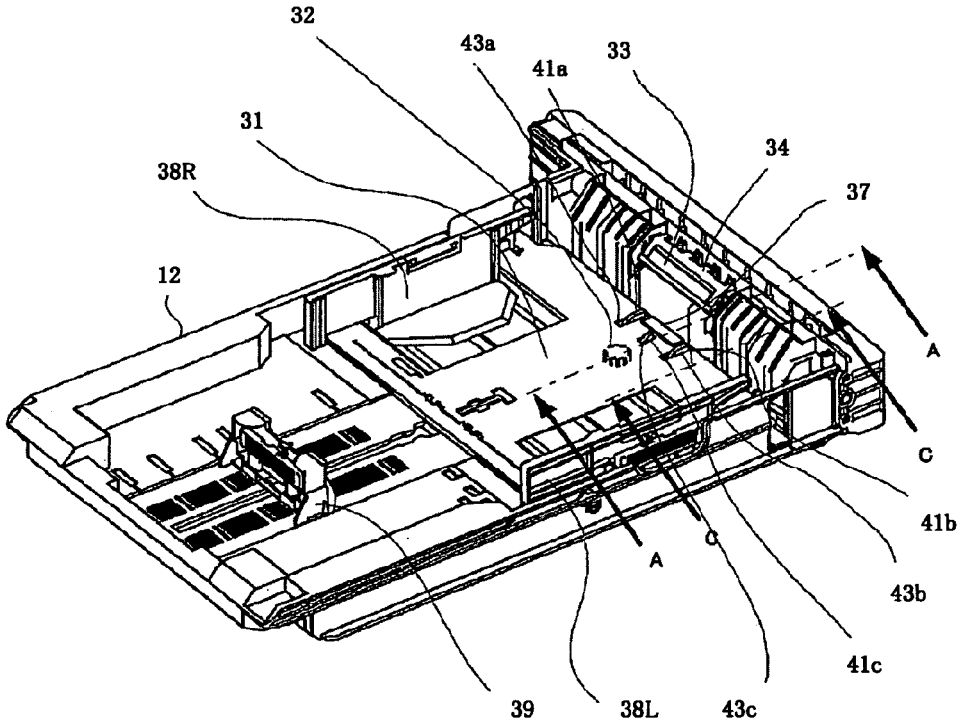
FIG. 1 is a first perspective view showing a configuration of a paper feed tray in a first embodiment with a sheet receiver at a lowered position.
Figure 3:
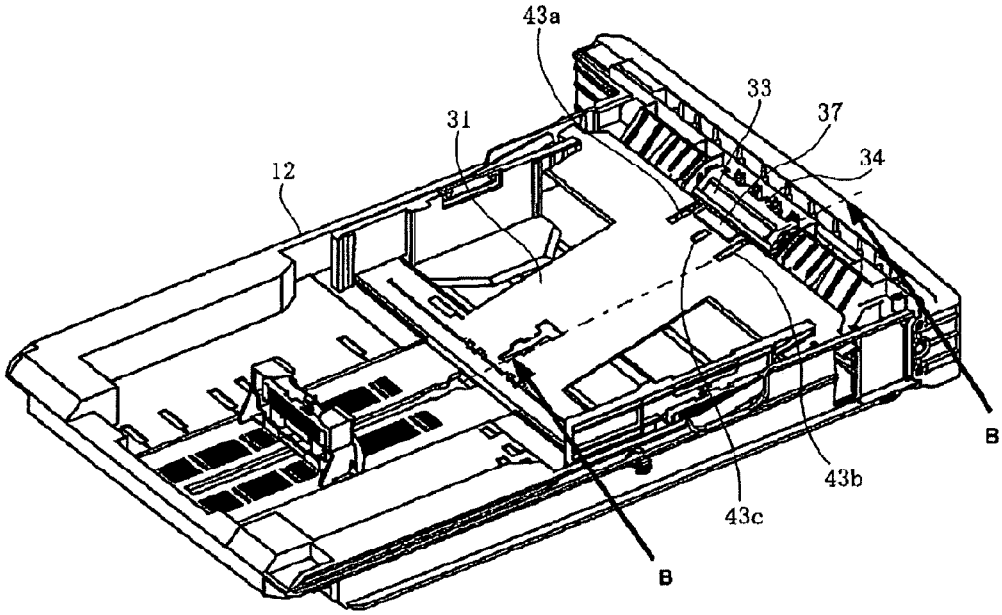
FIG. 3 is a second perspective view showing another configuration of the paper feed tray in the first embodiment with the sheet receiver at a raised position.

FIG. 1 is a first perspective view of the paper feed tray of the first embodiment with a sheet receiver at a lowered position. FIG. 3 is a second perspective view showing another configuration of the paper feed tray of the first embodiment with the sheet receiver at a raised position.

As shown in FIGS. 1 and 3, paper feed tray 12 includes sheet receiver 31 disposed closer to the downstream end in the paper-feeding direction (right side end in the drawing) of a bottom plate of paper feed tray 12. Sheet receiver 31 is configured to serve as a raisable and lowerable hopper made of a metal plate, and is supported so that sheet receiver 31 can turn an unillustrated rotation shaft. In this case, the bottom plate of paper feed tray 12 functions as a supporter configured to support sheet receiver 31 swingably. Multiple stacked media 11 are placed on sheet receiver 31.

Furthermore, push-up spring 32 is disposed below sheet receiver 31 and closer to the downstream end in the paper-feeding direction. Push-up spring 32 is configured to serve as an elevator made of a metallic coil spring. Push-up spring 32 is configured to bias sheet receiver 31 upward and to turn sheet receiver 31 such that a downstream end in the paper-feeding direction of sheet receiver 31 is raised from the bottom plate of paper feed tray 12. Thereby, sheet receiver 31 moves from a lowered position as shown in FIG. 1 to a raised position as shown in FIG. 3, allowing medium 11 placed on sheet receiver 31 to come into contact with paper-feeding roller 13 disposed above paper feed tray 12.

Moreover, platy friction member 37 made of rubber is pasted with an adhesive on the upper surface of sheet receiver 31, at a position facing paper-feeding roller 13 (i.e., position at the downstream end in the paper-feeding direction in the exemplified drawing). Friction member 37 is configured to have the same function as the friction member in the feeder described in the section of "Description of Related Art," and is capable of separating media 11 one by one that are fed from paper feed tray 12 by paper-feeding roller 13.

Furthermore, multiple window holes 43*a*, 43*b* and 43*c* penetrating sheet receiver 31 are formed in sheet receiver 31, at positions surrounding friction member 37 of sheet receiver 31. As shown in FIG. 1, when sheet receiver 31 is at the lowered position, ribs 41*a*, 41*b* and 41*c* are configured, as projecting members, to project through window hole 43*a*, 43*b* and 43*c*, respectively. Ribs 41*a*, 41*b* and 41*c* are formed to have a shape that allows medium 11 placed on the bottom plate of paper feed tray 12 to be lifted up. Collectively, ribs 41*a*, 41*b* and 41*c* are described as rib 41.

Paper feed tray 12 further includes pressure member 34 disposed in the vicinity of the downstream end in the paper-feeding direction. On the upper surface of pressure member 34, separator 33 made of rubber is pasted with an adhesive. Separator 33 is configured to separate media 11 from one another. Together with separator 33, pressure member 34 is configured to separate medium 11 from one another while biased by an unillustrated spring toward paper-feeding roller 13 disposed above pressure member 34.

Paper feed tray 12 further includes plastic medium-side guides 38R and 38L and medium-rear end guide 39. Medium-side guides 38R and 38L are configured to fit into a groove that is formed to extend perpendicularly to the paper-feeding direction, and are configured to align widths of media 11 with one another when media 11 are placed in paper feed tray 12. Medium-rear end guide 39 is configured to fit into a groove that is formed to extend in parallel to the paper-feeding direction, and configured to align the rear ends of media 11 with one another when media 11 are placed in paper feed tray 12.

Next, description is given of a change in the positional relation between sheet receiver 31 and rib 41.

Figure 4:
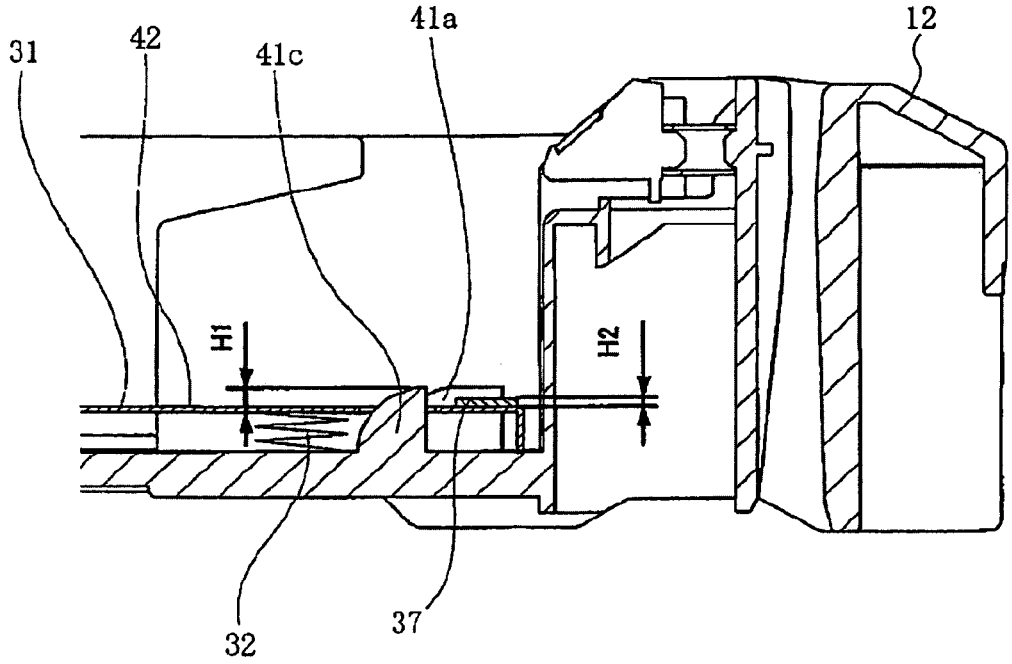
FIG. 4 is a cross-sectional view showing the sheet receiver in the first embodiment at the lowered position, the cross-sectional view taken along the line A-A indicated by arrows in FIG. 1.
Figure 5:
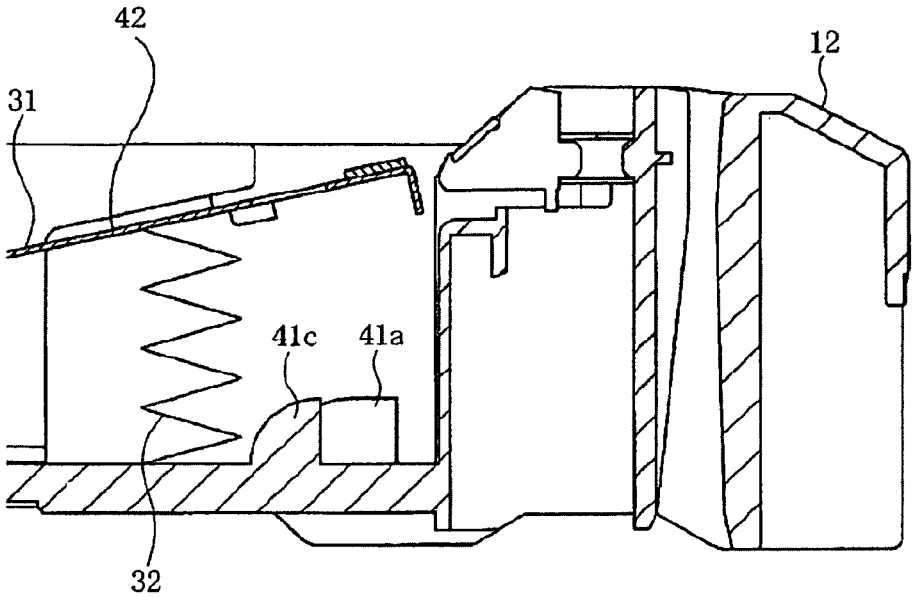
FIG. 5 is cross-sectional view showing the sheet receiver in the first embodiment at the raised position, the cross-sectional view taken along the line B-B indicated by arrows in FIG. 3.
Figure 6:
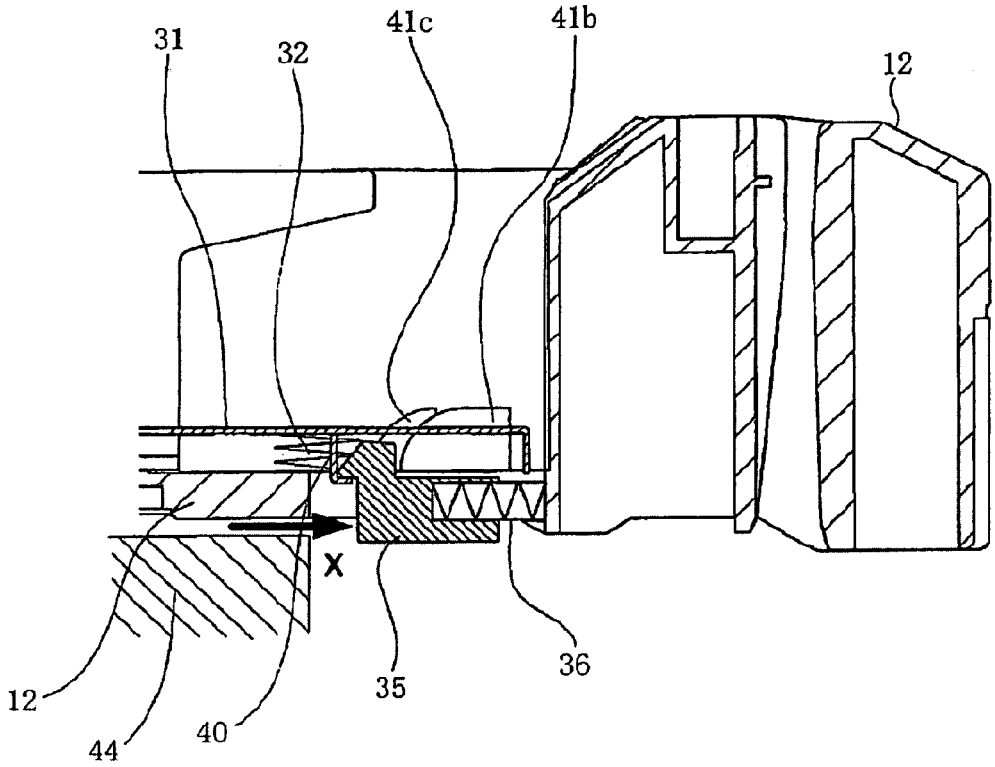
FIG. 6 is a cross-sectional view showing an elevating mechanism of the sheet receiver in the first embodiment, the cross-sectional view taken along the line C-C indicated by arrows in FIG. 1.

FIG. 4 is a cross-sectional view showing the sheet receiver of the first embodiment at the lowered position, the cross-sectional view taken along the line A-A indicated by arrows in FIG. 1. FIG. 5 is a cross-sectional view showing the sheet receiver of the first embodiment at the raised position, the cross-sectional view taken along the line B-B indicated by arrows in FIG. 3. FIG. 6 is a cross-sectional view showing an elevating mechanism of the sheet receiver of the first embodiment, the cross-sectional view taken along the line C-C indicated by arrows in FIG. 1.

In FIG. 4, reference numeral 42 denotes a medium-placing surface that is the upper surface of sheet receiver 31, and that contacts the lower surface of lowermost medium 11 among stacked media 11. In addition, with sheet receiver 31 at the lowered position as shown in FIG. 4, H1 denotes a height from medium-placing surface 42 to the upper tip end of rib 41; and H2 denotes a height from medium-placing surface 42 to the upper surface of friction member 37.

It can be seen from FIG. 5 that, when sheet receiver 31 is at the raised position, rib 41 does not project above medium-placing surface 42.

As shown in FIG. 6, sheet receiver 31 includes fixing claw 40. Fixing claw 40 is metallic protrusions attached by welding to positions closer to the downstream end in the paper-feeding direction of the lower surface of sheet receiver 31. Paper feed tray 12 further includes plastic stopper 35. Stopper 35 is disposed slidably along a groove that is formed to extend in parallel to the paper-feeding direction. Stopper 35 is biased by spring 36, made of a metallic coil spring, in a direction (indicated by arrow X in the drawing) opposite to the paper-feeding direction. When sheet receiver 31 is at the lowered position, stopper 35 is engageable with fixing claw 40.

Additionally, reference numeral 44 denotes a colliding unit that is a plastic bulge formed in the main body of image forming apparatus 10. When paper feed tray 12 is mounted on image forming apparatus 10, stopper 35 comes into contact with colliding unit 44 and is moved in the paper-feeding direction. Thereby, stopper 35 is disengaged from fixing claw 40.

Next, described are operations of image forming apparatus 10 having the above-described configuration. First of all, overall operations of image forming apparatus 10 are described.

First, multiple media 11 stacked on paper feed tray 12 of the feeder are picked up by paper-feeding roller 13 driven by an unillustrated conveying motor, and fed to conveying roller 14. At this point, even when multiple media 11 are pulled out due to friction between the adjacent media 11, media 11 are separated from one another by separator 33, and then fed one by one.

Subsequently, medium 11 is conveyed to image former 16 along the conveying path by conveying rollers 14 and 15. In image former 16, a toner image is transferred onto medium 11 by each process unit 17. Thereafter, medium 11 having the toner images thus transferred is conveyed to image fixer 18 disposed on the downstream side.

Image fixer 18 fixes the toner images on medium 11 by heating and pressuring the toner image. After that, medium 11 having the toner images thus fixed by image fixer 18 is discharged from the medium discharger to the outside of the main body of image forming apparatus 10 by discharge roller 19, which is driven by an unillustrated discharging motor.

Next, operations of the feeder are described.

First, when media 11 are placed in paper feed tray 12, sheet receiver 31 is immobilized at the lowered position. At this point, when the operator pushes down sheet receiver 31 by hand, fixing claw 40 is brought into contact with an inclined surface provided to stopper 35. Sheet receiver 31 is further pushed down with fixing claw 40 that contacts the inclined surface. Accordingly, spring 36 is compressed, and stopper 35 moves in the paper-feeding direction. Then, stopper 35 engages with fixing claw 40. Note that, when stopper 35 engages with fixing claw 40, spring 36 biases stopper 35 in the direction opposite to the paper-feeding direction. Thereby, sheet receiver 31 is held at the lowered position.

Meanwhile, when paper feed tray 12 is set on image forming apparatus 10 with sheet receiver 31 held at the lowered position, stopper 35 is brought into contact with colliding unit 44. Thereby, spring 36 is compressed, and stopper 35 moves in the paper-feeding direction. Accordingly, stopper 35 is disengaged from fixing claw 40. Thus, the downstream end in the paper-feeding direction of sheet receiver 31 is pushed up by push-up spring 32, and sheet receiver 31 moves to the raised position.

Meanwhile, when sheet receiver 31 is at the lowered position, ribs 41*a*, 41*b* and 41*c* provided to paper feed tray 12 project above the upper surface of sheet receiver 31 through window hole 43*a*, 43*b* and 43*c* formed at the positions surrounding friction member 37, respectively. At this point, height H1 from medium-placing surface 42 to the upper tip ends of ribs 41*a*, 41*b* and 41*c* is higher than height H2 from medium-placing surface 42 to the upper surface of friction member 37. In other words, the relationship of:

$H2<H1$ is satisfied.

For this reason, when media 11 are placed in paper feed tray 12 with sheet receiver 31 at the lowered position, the lower surface of lowermost medium 11 among stacked media 11 comes into contact with ribs 41*a*, 41*b* and 41*c*, but does not come into contact with friction member 37 directly. Thereby, after media 11 are placed in paper feed tray 12, the positions of all stacked media 11 are easily adjusted by moving medium-side guides 38R and 38L as well as medium-rear end guide 39, even in a case of small positional adjustment of front, rear, right and left sides of media 11.

On the other hand, when sheet receiver 31 is at the raised position, ribs 41*a*, 41*b* and 41*c* do not project above the upper surface of sheet receiver 31. For this reason, the lower surface of lowermost medium 11 among stacked media 11 comes into contact with friction member 37. Thus, multiple media 11 are not caused to move in the paper-feeding direction by paper-feeding roller 13.

In this manner, in this embodiment, when sheet receiver 31 is at the lowered position, lowermost medium 11 among stacked media 11 does not come into contact with friction member 37. Therefore, when media 11 are placed in paper feed tray 12, the alignment of all stacked media 11 can be maintained without lowermost medium 11 being offset from other media 11. Moreover, the positional adjustment of stacked media 11 is facilitated by medium-side guides 38R and 38L as well as medium-rear end guide 39.

Next, a second representative example is described. Note that, components having the same structures as those in the first example have the same reference symbols. Thus, description thereof is omitted. Moreover, description of the same operations and effect as those in the first example is omitted also.

Figure 7:
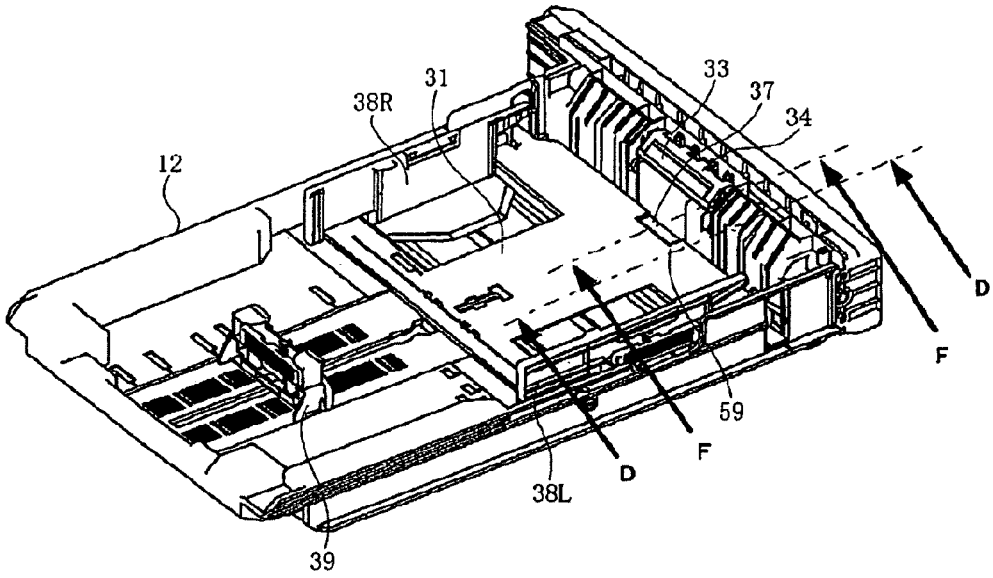
FIG. 7 is a first perspective view showing a configuration of a paper feed tray in a second embodiment with a sheet receiver at a lowered position.
Figure 8:
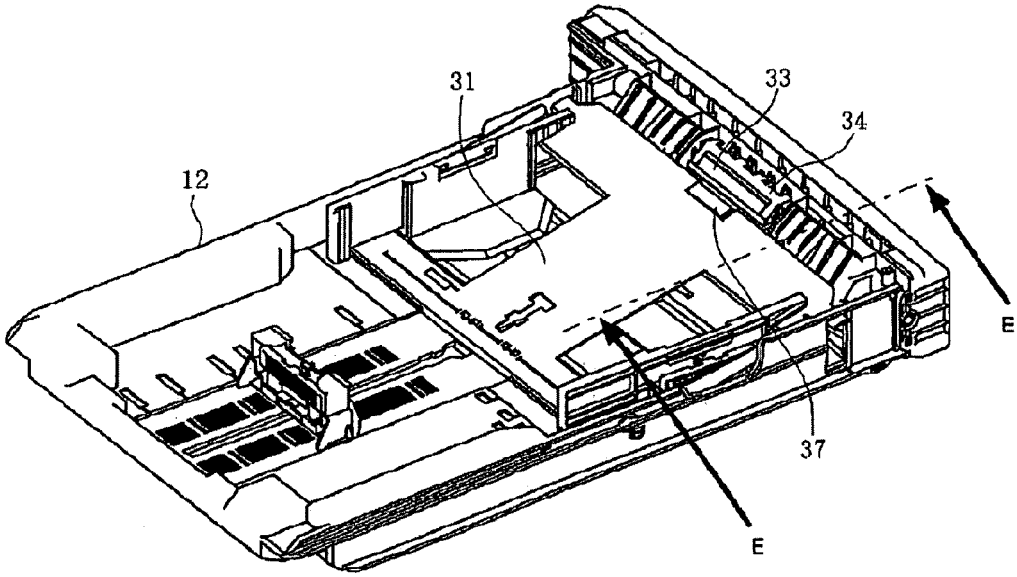
FIG. 8 is a second perspective view showing another configuration of the paper feed tray in the second embodiment with the sheet receiver at a raised position.
Figure 9:
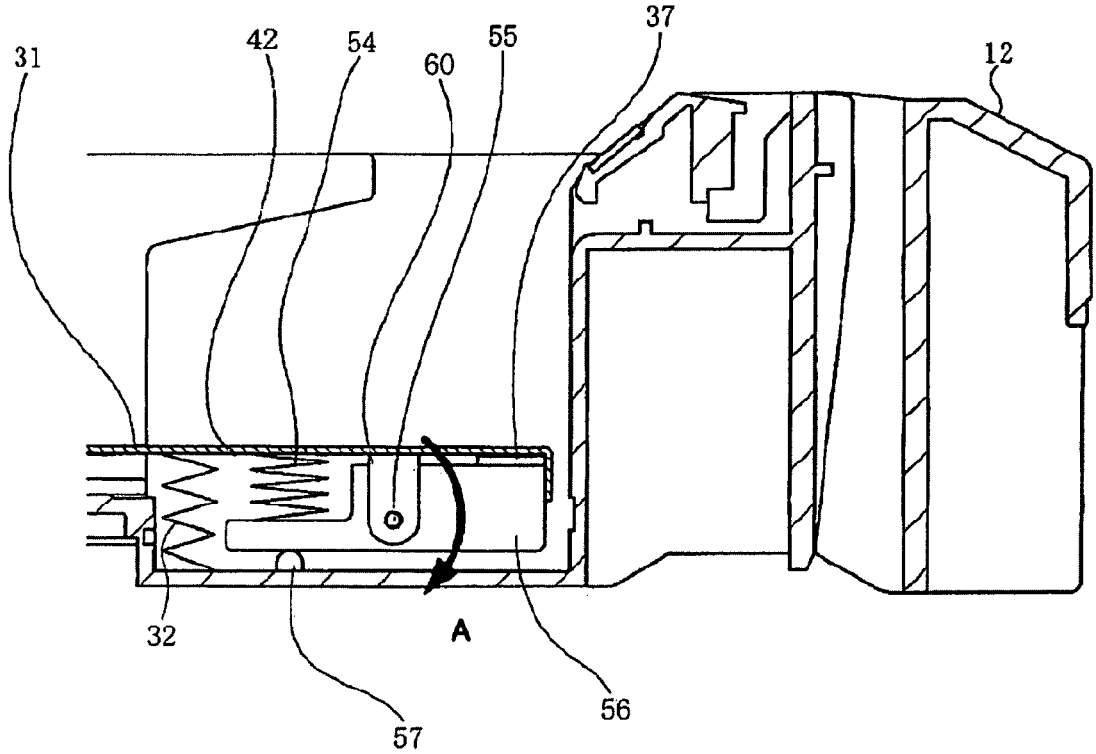
FIG. 9 is a cross-sectional view showing the sheet receiver in the second embodiment at the lowered position, the cross-sectional view taken along the line D-D indicated by arrows in FIG. 7.
Figure 10:
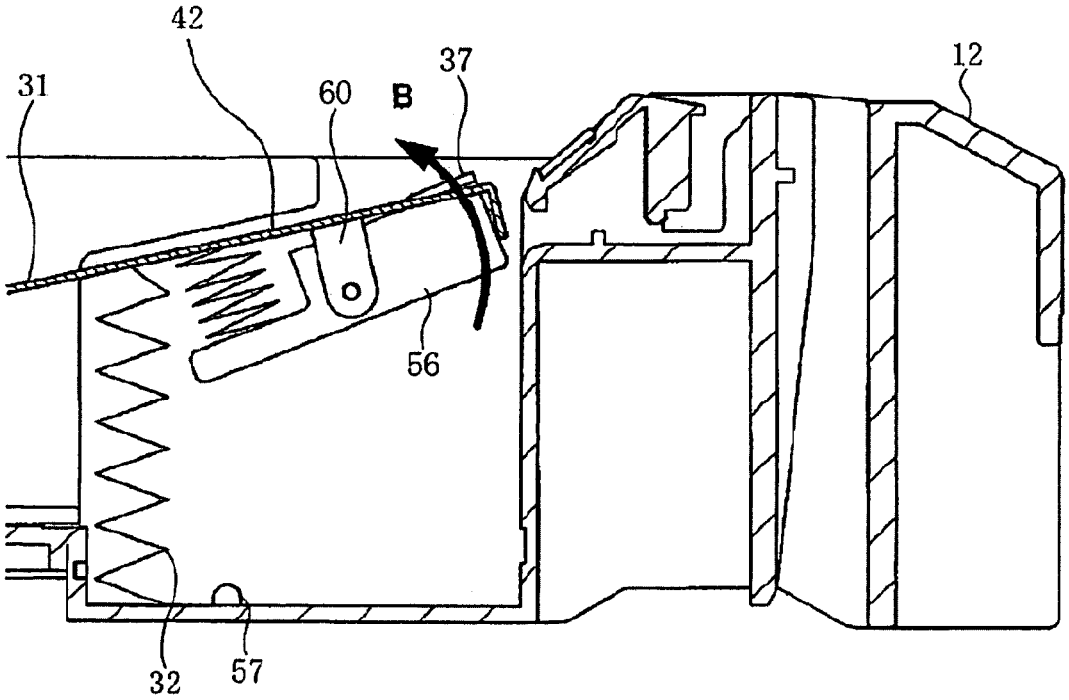
FIG. 10 is a cross-sectional view showing the sheet receiver in the second embodiment at the raised position, the cross-sectional view taken along the line E-E indicated by arrows in FIG. 8.
Figure 11:
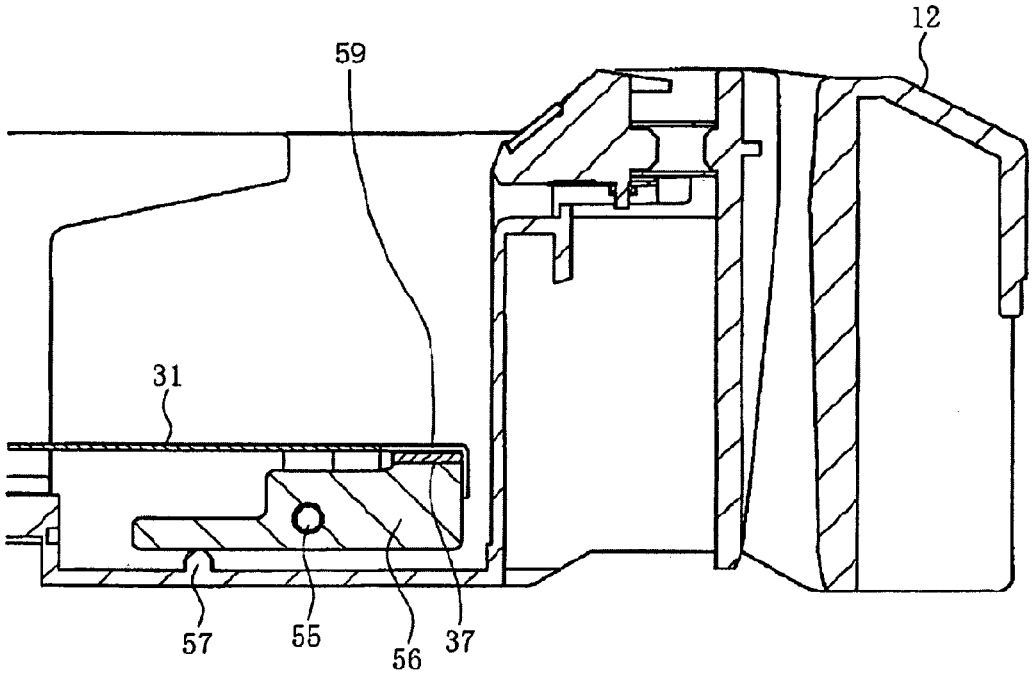
FIG. 11 is a cross-sectional view showing an elevating mechanism of the sheet receiver in the second embodiment, the cross-sectional view taken along the line F-F indicated by arrows in FIG. 7.

FIG. 7 is a first perspective view showing a configuration of a paper feed tray of the second embodiment with a sheet receiver at a lowered position. FIG. 8 is a second perspective view showing another configuration of the paper feed tray of the second embodiment with the sheet receiver at a raised position. FIG. 9 is a cross-sectional view showing the sheet receiver of the second embodiment at the lowered position, the cross-sectional view taken along the line D-D indicated by arrows in FIG. 7. FIG. 10 is a cross-sectional view showing the sheet receiver of the second embodiment at the raised position, the cross-sectional view taken along the line E-E indicated by arrows in FIG. 8. FIG. 11 is a cross-sectional view showing an elevating mechanism of the sheet receiver in the second embodiment, the cross-sectional view taken along the line F-F indicated by arrows in FIG. 7.

In this embodiment, as shown in FIG. 9, bearing 60 made of a metallic platy body is attached by welding to the lower surface of sheet receiver 31, in the vicinity of the downstream end in the paper-feeding direction. Metallic rotation shaft 55 is rotatably supported by bearing 60. Furthermore, rotation shaft 55 is attached to plastic fixing member 56 that has a hole formed at the center of rotation, and rotation shaft 55 is inserted through the hole. Additionally, friction member 37 is pasted with an adhesive to the upper surface of fixing member 56, at a downstream end in the paper-feeding direction.

Moreover, spring 54 made of a metallic coil spring is disposed between fixing member 56 and sheet receiver 31, at a position upstream of rotation shaft 55 in the paper-feeding direction. Spring 54 is configured to bias fixing member 56 in a direction such that the gap between sheet receiver 31 and fixing member 56 is widened. Furthermore, plastic rotation stopper 57 of a protrusion-like shape is formed on the upper surface of the bottom plate of paper feed tray 12, at a position facing a portion of fixing member 56, which is upstream of rotation shaft 55 in the paper-feeding direction.

Additionally, as shown in FIG. 11, notch 59 is formed in sheet receiver 31, at the downstream end in the paper-feeding direction. Specifically, notch 59 is formed at a position corresponding to friction member 37 on fixing member 56. Note that the other configurations in this embodiment are the same as those in the first embodiment, and description thereof are omitted.

Next, operations of the feeder of the second embodiment are described.

First, when media 11 are placed in paper feed tray 12, sheet receiver 31 is immobilized at the lowered position. In this case, when the operator pushes down sheet receiver 31 by hand, fixing member 56 is brought into contact with rotation stopper 57 of paper feed tray 12. Sheet receiver 31 is further pushed down with fixing member 56 being in contact with rotation stopper 57. Thus, spring 54 is compressed, and fixing member 56 turns in a direction indicated by arrow A in FIG. 9 while rotation shaft 55 serves as the turning center. Accordingly, friction member 37 on fixing member 56 turns, together with fixing member 56, in the direction indicated by arrow A. Consequently, friction member 37 is positioned below medium-placing surface 42 of sheet receiver 31.

For this reason, when media 11 are placed with sheet receiver 31 at the lowered position, the lower surface of lowermost medium 11 among stacked media 11 does not come into contact with friction member 37 directly. Thereby, after media 11 are placed in paper feed tray 12, the positions of all stacked media 11 are easily adjusted by moving medium-side guides 38R and 38L as well as medium-rear end guide 39, even in a case of small positional adjustment of front, rear, right and left sides of media 11.

Subsequently, when paper feed tray 12 is set on image forming apparatus 10 with sheet receiver 31 held at the lowered position, stopper 35 is disengaged from fixing claw 40 as in the case of the first embodiment. Then, the downstream end, in the paper-feeding direction, of sheet receiver 31 is pushed up by push-up spring 32, and sheet receiver 31 moves to the raised position.

Then, fixing member 56 is biased by spring 54 and turns in a direction indicated by arrow B in FIG. 10 while rotation shaft 55 serves as the turning center. At this point, fixing member 56 continues turning until fixing member 56 comes into contact with sheet receiver 31. When fixing member 56 stops turning, friction member 37 projects above medium-placing surface 42 of sheet receiver 31. For this reason, the lower surface of lowermost medium 11 among stacked media 11 comes into contact with friction member 37. Thus, multiple media 11 are not caused to move in the paper-feeding direction by paper-feeding roller 13.

In this manner, in this embodiment, when sheet receiver 31 is at the lowered position, friction member 37, rib 41, and the like do not project from medium-placing surface 42 of sheet receiver 31. Thus, even in a case where medium 11 is a material vulnerable to scratch, for example, an over head projector (OHP) sheet, medium 11 can be placed in paper feed tray 12 while being prevented from damage. Moreover, medium-placing surface 42 does not have any protrusion thereon. Accordingly, even when media 11 having been placed in paper feed tray 12 are left alone for an extended period without paper feed tray 12 set on image forming apparatus 10, surface waviness does not occur on media 11 because of medium-placing surface 42.

The first and second embodiments are described with image forming apparatus 10 as an electrophotographic printer. However, as long as image forming apparatus 10 includes a feeder having a sheet receiver with a friction member, the present invention can be applied to any type of image forming apparatus such as a copier, a facsimile and a multi function printer (MFP), employing various printing methods.

Moreover, in the first and second embodiments, description has been given wherein sheet receiver 31 to the feeder can turn. However, the present invention can be applied to a feeder in which a sheet receiver moves vertically, and is applicable regardless of the mode of the sheet receiver's elevator.

Moreover, in the first and second embodiments, description has been given wherein three window holes, which are 43*a*, 43*b*, and 43*c* that correspond to ribs 41*a*, 41*b*, and 41*c* as projecting members are arranged at positions surrounding friction member 37. Meanwhile, two window holes, which are 43*a* and 43*b* that correspond to ribs 41*a* and 41*b* as projecting members may be arranged at positions both sides of friction member 37. Still, a single window hole, which is 43*c* that corresponds to ribs 41*c* as a projecting member may be arranged at the front portion of friction member 37

As has been described, in the feeder and the image forming apparatus including the feeder according to the present embodiments, a friction member is disposed at a position facing a pick-up roller above a raisable and lowerable hopper. Meanwhile, projecting members that can project from the surface of the hopper are disposed around the friction member. When the hopper is at a lowered position, the projecting members project from the hopper. Thereby, even the lowermost medium does not come into contact with the friction member when media are placed in the feeder. This facilitates media setting and positional adjustment of the media.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A feeder comprising:

a raisable and lowerable hopper on which a plurality of media are stacked;

an elevator configured to move the hopper to any one of a raised position and a lowered position;

a pick-up roller configured to pick up an uppermost media stacked on the hopper by rotating while contacting the uppermost medium when the hopper is at the raised position;

a friction member disposed on an upper surface of the hopper, at a position facing the pick-up roller; and a projecting member disposed below the hopper, wherein the hopper includes a window hole formed in the vicinity of the friction member, and when the hopper is at the lowered position, the projecting member projects from the upper surface of the hopper through the window hole.

2. The feeder of claim 1, further comprising a supporter configured to support the hopper swingably, wherein the hopper is configured to swung for raising and lowering, and the projecting member is formed at a position on the supporter corresponding to the window hole.

3. The feeder of claim 1, wherein when the hopper is at the lowered position the projecting member projecting from the hopper reaches a position higher than the friction member.

4. The feeder of claim 1, wherein when the hopper is at the raised position the projecting member does not project from the hopper.

5. The feeder of claim 1, wherein the elevator comprises a coil spring.

6. The feeder of claim 1, further comprising:

a fixing claw provided to a lower surface of the hopper;

a stopper; and a stopper mover configured to move the stopper, wherein the stopper is disposed slidably along a groove that extends parallel to a medium-feeding direction, the stopper is biased by the stopper mover in a direction opposite to the medium-feeding direction, and when the hopper is at the lowered position, the stopper engages with the fixing claw.

7. The feeder of claim 1, wherein the hopper includes multiple window holes formed around the friction member.

8. An image forming apparatus comprising:

a feeder including:

a raisable and lowerable hopper on which a plurality of media are stacked;

an elevator configured to move the hopper to any one of a raised position and a lowered position;

a pick-up roller configured to pick up an uppermost media stacked on the hopper by rotating while contacting the uppermost medium when the hopper is at the raised position;

a friction member disposed on an upper surface of the hopper, at a position facing the pick-up roller;a projecting member disposed below the hopper;

a conveying roller configured to convey the medium picked up by the pick-up roller;

an image former configured to transfer a toner image to the medium conveyed by the conveying roller; and an image fixer configured to fix the toner image to the medium, wherein the hopper includes a window hole formed in the vicinity of the friction member, and when the hopper is at the lowered position, the projecting member projects from the upper surface of the hopper through the window hole.

9. An image forming apparatus comprising:

a feeder including:

a raisable and lowerable hopper on which a plurality of media are stacked;

an elevator configured to move the hopper to any one of a raised position and a lowered position;

a pick-up roller configured to pick up an uppermost media stacked on the hopper by rotating while contacting the uppermost medium when the hopper is at the raised position:

a friction member disposed on an upper surface of the hopper, at a position facing the pick-up roller;a projecting member disposed below the hopper:

a conveying roller configured to convey the medium picked up by the pick-up roller;

an image former configured to transfer a toner image to the medium conveyed by the conveying roller: and an image fixer configured to fix the toner image to the medium, wherein the hopper includes a window hole formed in the vicinity of the friction member, and when the hopper is at the lowered position, the projecting member projects from the upper surface of the hopper through the window hole and wherein the hopper includes multiple window holes formed around the friction member.

10. A feeder comprising:

a raisable and lowerable hopper on which a plurality of media are stacked;

an elevator configured to move the hopper to any one of a raised position and a lowered position;

a pick-up roller configured to pick up an uppermost media stacked on the hopper by rotating while contacting the uppermost medium when the hopper is at the raised position;

a friction member disposed on an upper surface of the hopper, at a position facing the pick-up roller; and a projecting member disposed below the hopper, wherein the hopper includes a window hole formed in the vicinity of the friction member, and wherein the projecting member comprises:

a first projecting member subunit disposed at a position upstream in the paper-feeding direction and substantially center of the friction member;

a second projecting member subunit disposed at one side of the friction member; and a third projecting member subunit disposed at the other side of the friction member.

11. A feeder comprising:

a raisable and lowerable hopper on which a plurality of media are stacked;

an elevator configured to move the hopper to any one of a raised position and a lowered position;

a pick-up roller configured to pick up an uppermost media stacked on the hopper by rotating while contacting the uppermost medium when the hopper is at the raised position;

a friction member disposed on an upper surface of the hopper, at a position facing the pick-up roller: and a projecting member having first, second and third subunits disposed below the hopper, wherein the hopper includes a window hole formed in the vicinity of the friction member, and when the hopper is at the lowered position, the projecting member projects from the upper surface of the hopper through the window hole and wherein the second and third projecting member subunits are longer in the paper-feeding direction than the first projecting member.

12. The feeder of claim 11, wherein the top of each of the first, second and third projecting member subunits has an inclination portion in the paper-feeding direction.

13. The feeder of claim 12, wherein the inclination portion is round.

14. The feeder of claim 13, wherein each of the second and third projecting member subunits has a horizontal portion extending to the inclination portion.

* * * * *